US006164086A

United States Patent [19]

Kita et al.

[11] Patent Number: 6,164,086

[45] Date of Patent: Dec. 26, 2000

[54] AIR CONDITIONER

[75] Inventors: Koichi Kita; Nobuo Domyo; Ryuzaburo Yajima; Kazuyuki Nishikawa, all of Osaka, Japan

[73] Assignee: Daikin Industries, Ltd., Osaka, Japan

[21] Appl. No.: 09/051,601

[22] PCT Filed: Aug. 7, 1997

[86] PCT No.: PCT/JP97/02745

§ 371 Date: Apr. 14, 1998

§ 102(e) Date: Apr. 14, 1998

[87] PCT Pub. No.: WO98/06983

PCT Pub. Date: Feb. 19, 1998

[30] Foreign Application Priority Data

Aug. 14, 1996 [JP] Japan ..... 8-214515

[51] Int. Cl.[7] ..... F25B 41/00

[52] U.S. Cl. ..... 62/513; 62/175; 62/196.4; 62/201; 62/502

[58] Field of Search ..... 62/502, 513, 335, 62/201, 196.4, 175

[56] References Cited

U.S. PATENT DOCUMENTS

| | | |
|---|---|---|
| 5,056,329 | 10/1991 | Wilkinson . |
| 5,062,985 | 11/1991 | Takemasa . |
| 5,092,138 | 3/1992 | Radermacher et al. . |
| 5,095,712 | 3/1992 | Narreau . |
| 5,186,011 | 2/1993 | Yoshida et al. . |
| 5,243,837 | 9/1993 | Radermacher et al. . |
| 5,542,271 | 8/1996 | Kudoh et al. . |

FOREIGN PATENT DOCUMENTS

| | | |
|---|---|---|
| 0 601 875 A1 | 6/1994 | European Pat. Off. . |
| 0 685 692 A2 | 12/1995 | European Pat. Off. . |
| 4-324072 | 11/1982 | Japan . |
| 59-116777 | 8/1984 | Japan . |
| 59-153074 | 8/1984 | Japan . |
| 1-296053 | 11/1989 | Japan . |
| 2-247671 | 10/1990 | Japan . |
| 2-306064 | 12/1990 | Japan . |
| 6-331223 | 11/1994 | Japan . |
| 8-75290 | 3/1996 | Japan . |
| WO 93/18357 | 9/1993 | WIPO . |

*Primary Examiner*—William Doerrler
*Assistant Examiner*—Marc Norman
*Attorney, Agent, or Firm*—Birch, Stewart, Kolasch & Birch, LLP

[57] ABSTRACT

An air conditioner has a refrigerant circuit 1 in which a refrigerant flows through a compressor 2, a condenser 3, a supercooling heat exchanger 10, a first expansion mechanism 4 and an evaporator 5 in this order. In this refrigerant circuit 1, the refrigerant discharged from the compressor 2 is condensed in the condenser 3 and the condensed refrigerant is supercooled in the supercooling heat exchanger 10. This refrigerant is reduced in pressure in the first expansion mechanism 4, thereafter evaporated in the evaporator 5 and sucked into the compressor. Use of a nonazeotrope refrigerant as the above refrigerant can increase the refrigerating capacity improving effect due to supercooling as compared with the case where a single refrigerant is used.

14 Claims, 10 Drawing Sheets

AIR CONDITIONER

This application claims the benefit under 35 U.S.C. §371 of prior PCT International Application No. PCT/JP97/02745 which has an International filing date of Aug. 7, 1997 which designated the United States of America, the entire contents of which are hereby incorporated by references.

TECHNICAL FIELD

The present invention relates to air conditioners. The present invention relates, in particular, to an air conditioner having a refrigerant circuit in which a refrigerant flows through a compressor, a condenser, a supercooling heat exchanger for supercooling the refrigerant, an expansion mechanism and an evaporator in this order.

BACKGROUND ART

Referring to FIG. 10, as a refrigerant circuit 301 of an air conditioner of the above type, there is a known one which includes a main circuit 306 having a compressor 302, a condenser 303, a double-pipe type heat exchanger 310 for supercooling, a main expansion mechanism 304, an evaporator 305, a four-way changeover valve 309 and an accumulator 308 arranged in this order and a bypass circuit (indicated by dash lines) 313 which diverges from the main circuit 306 at a junction 321 between the condenser 303 and the double-pipe type heat exchanger 310, passes through a bypass expansion mechanism 312 and the double-pipe type heat exchanger 310 and joins the main circuit 306 at a juncture 322 in the vicinity of the inlet of the accumulator 308. A single refrigerant such as HCFC (hydrochlorofluorocarbon) 22 has conventionally been used as the refrigerant. The refrigerant discharged from the compressor 302 is condensed by the condenser 303 (which discharges heat to, for example, the outdoor air) and diverges at the junction 321 into a main-flow refrigerant which flows through the main circuit 306 and a bypass-flow refrigerant which flows through the bypass circuit 313. This main-flow refrigerant is supercooled by heat exchange with the bypass-flow refrigerant that has passed through the bypass expansion mechanism 312 in the double-pipe type heat exchanger 310 and thereafter reduced in pressure by the main expansion mechanism 304. Then, the main-flow refrigerant is evaporated by the evaporator 305 (which absorbs heat from, for example, the indoor air) and sucked into the compressor 302 through the four-way changeover valve 309 and the accumulator 308 for executing a gas-liquid separating operation. On the other hand, the bypass-flow refrigerant is reduced in pressure through the bypass expansion mechanism 312 and thereafter evaporated by heat exchange with the main-flow refrigerant in the double-pipe type heat exchanger 310. Subsequently, the bypass-flow refrigerant joins the main-flow refrigerant at the juncture 322 in the vicinity of the inlet of the accumulator 308.

By thus supercooling the main-flow refrigerant in the double-pipe type heat exchanger 310, a refrigerating effect to be produced by the main-flow refrigerant can be increased as compared with the case where no supercooling is executed. Furthermore, by diverging the bypass flow from the refrigerant flow, the volumetric flow rate of the main-flow refrigerant is reduced. Therefore, as indicated by a pressure to specific enthalpy diagram (referred to as a "Ph diagram" hereinafter) shown in FIG. 11B, a pressure loss $\Delta P$ can be reduced inside the evaporator 305 and at the inlet side pipe of the compressor 302 (for the sake of comparison, a pressure loss $\Delta P_0$ in the case where no supercooling is executed is shown in FIG. 11A). Accordingly, the refrigerating capacity of the system can be improved. It is to be noted that the portions denoted by A, B and C in FIG. 11B correspond to the states at the points A, B and C in the vicinity of the juncture 322 of the refrigerant circuit 301 shown in FIG. 10. As is clearly shown in FIG. 11C that is an enlarged view of part of FIG. 11B, the bypass-flow refrigerant reaching the point A and the main-flow refrigerant reaching the point B join together, thereby obtaining the state at the point C.

There is a constant demand for increasing the refrigerating capacity of the air conditioner, and there is no limitation on the demand for increasing the refrigerating capacity.

DISCLOSURE OF THE INVENTION

The object of the present invention is to improve the refrigerating capacity further than in the prior arts.

In order to achieve the above object, the present invention provides an air conditioner having a refrigerant circuit in which a refrigerant flows through a compressor, a condenser, a supercooling heat exchanger, a first expansion mechanism and an evaporator in this order, wherein a nonazeotrope refrigerant is used as the refrigerant.

In this air conditioner, the boiling points of refrigerants constituting the nonazeotrope refrigerant differ from each other, and therefore, a gradient (inclination to the specific enthalpy axis, referred to as a "temperature gradient" hereinafter) is generated at the isothermal line in a dual-phase region (wet steam range) of a Ph diagram representing the state of the refrigerant. Due to the temperature gradient in this dual-phase region, the inlet temperature of the evaporator is reduced as compared with the case where a single refrigerant is used. Therefore, a temperature difference between the fluid (indoor air, for example) whose heat is absorbed by the evaporator and the refrigerant passing through the evaporator becomes great, thereby increasing the heat exchanging ability of the evaporator. As a result, the refrigerating capacity improving effect due to supercooling is further increased by the quantity of increase of the heat exchanging ability of the evaporator as compared with the case where a single refrigerant is used.

In the air conditioner of this first embodiment, the refrigerant circuit has a bypass circuit which diverges from a main circuit between the condenser and the first expansion mechanism and joins the main circuit on the inlet side of the compressor and includes a second expansion mechanism in the bypass circuit, and the supercooling heat exchanger executes heat exchange between a main-flow refrigerant flowing through the main circuit and a bypass-flow refrigerant that has passed through the second expansion mechanism and flows through the bypass circuit.

In this air conditioner, the main-flow refrigerant can be supercooled with a simple circuit construction utilizing the bypass-flow refrigerant that has passed through the second expansion mechanism.

Further, in the air conditioner of this first embodiment, the bypass circuit diverges from the main circuit between the condenser and the supercooling heat exchanger.

In this air conditioner, the object to be supercooled by the supercooling heat exchanger becomes only the main-flow refrigerant, and therefore, the size of the supercooling heat exchanger is allowed to be relatively small.

In an air conditioner of another embodiment, the bypass circuit diverges from the main circuit between the supercooling heat exchanger and the first expansion mechanism.

In this air conditioner, the bypass-flow refrigerant that has passed through the supercooling heat exchanger and is thereafter made to diverge from the main-flow refrigerant enters the second expansion mechanism, and this reduces the possibility of the entry of the dual-phase flow into the second expansion mechanism. Therefore, the second expansion mechanism has no chance to cause hunting and hence operates stably.

In the air conditioner of the first embodiment, the supercooling heat exchanger is a counter flow type heat exchanger in which the main-flow refrigerant and the bypass-flow refrigerant flow in opposite directions with interposition of a wall having a heat transfer property.

In this air conditioner, an average temperature difference between the main-flow refrigerant and the bypass-flow refrigerant which are provided by the nonazeotrope refrigerant becomes relatively great on both sides of the wall which belongs to the supercooling heat exchanger and has a heat transfer property. For instance, the temperature difference becomes greater than the average temperature difference in the case of a parallel flow type heat exchanger. As a result, the capacity of the supercooling heat exchanger improves.

In the air conditioner of another embodiment, the supercooling heat exchanger supercools the refrigerant by means of low-temperature heat stored in ice.

In this air conditioner, the supercooling heat exchanger supercools the refrigerant by means of the low-temperature heat stored in the ice. Therefore, the refrigerant can be effectively supercooled.

In the air conditioner of another embodiment, the supercooling heat exchanger of the refrigerant circuit supercools the refrigerant by means of low-temperature heat supplied from another refrigerant circuit.

In this air conditioner, the supercooling heat exchanger of the refrigerant circuit supercools the refrigerant by means of the low-temperature heat supplied from another refrigerant circuit, and therefore, the refrigerant can be effectively supercooled.

BEST MODE FOR CARRYING OUT THE INVENTION

Embodiments of the air conditioner of the present invention will be described in detail below with reference to the accompanying drawings.

First Embodiment

Figure 1A:
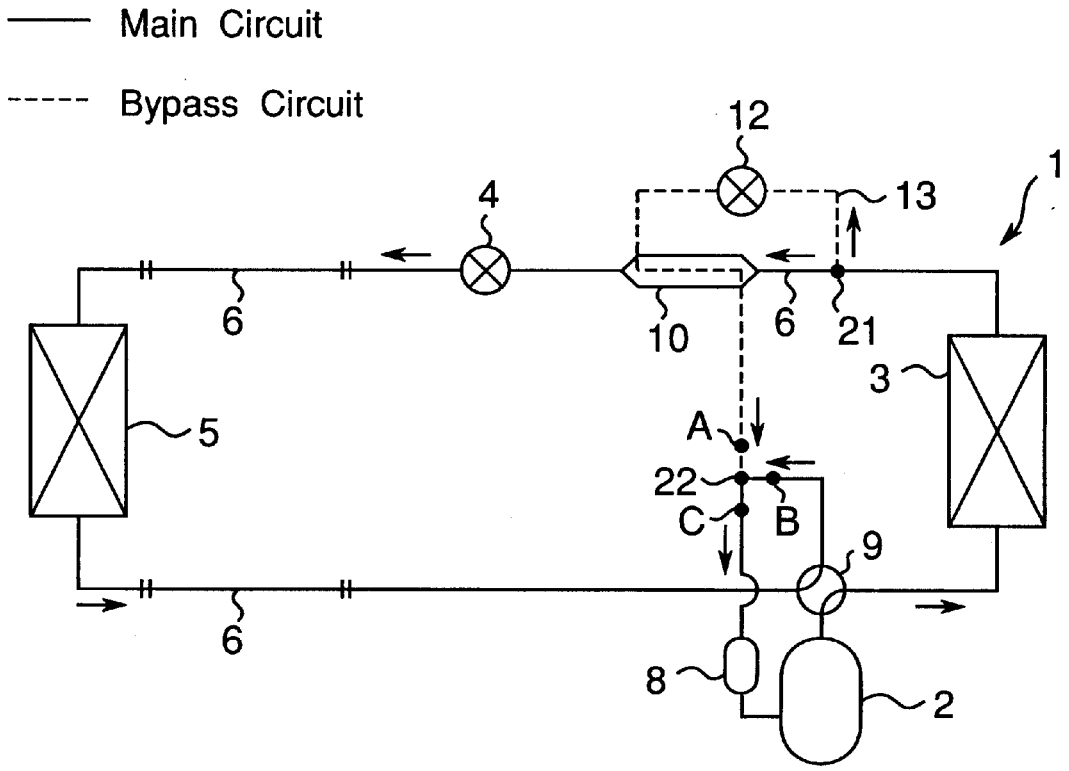
FIG. 1A is a diagram showing the construction of a refrigerant circuit of an air conditioner according to a first embodiment of the present invention.

Referring to FIG. 1A, an air conditioner according to one embodiment of the present invention has a refrigerant circuit 1 including a main circuit 6 and a bypass circuit (indicated by dash lines) 13. As a refrigerant to be circulated through the refrigerant circuit 1, a nonazeotrope refrigerant comprised of R-32/134a or R-407C is used.

Figure 4A:
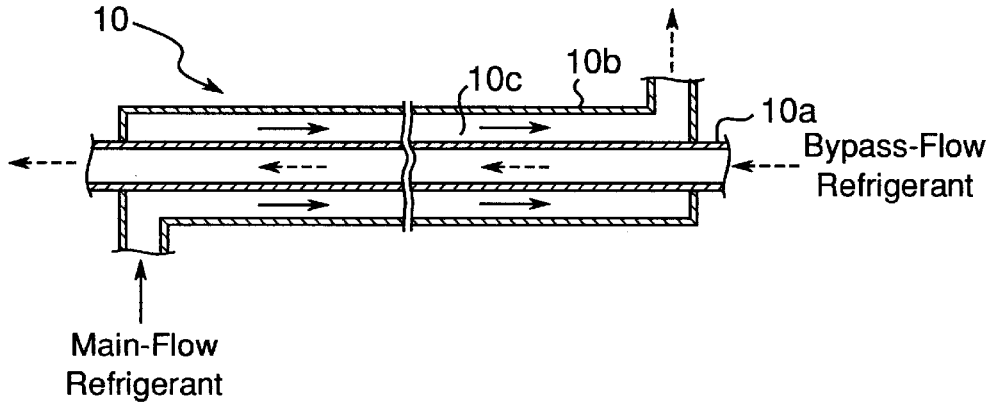
FIG. 4A is a diagram showing the construction of a double-pipe type heat exchanger of the refrigerant circuit of FIG. 1.
Figure 4B:
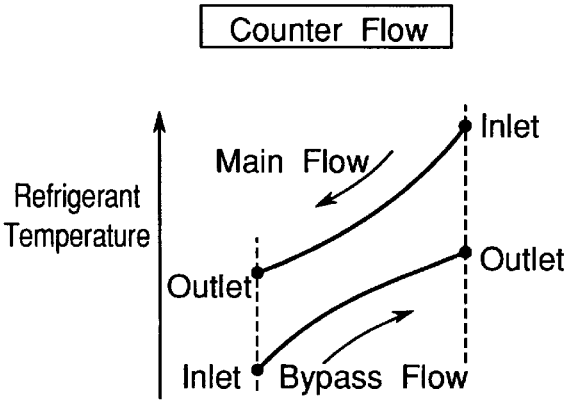
FIG. 4B is a diagram for explaining a refrigerant temperature in a counter flow type heat exchanger.
Figure 4C:
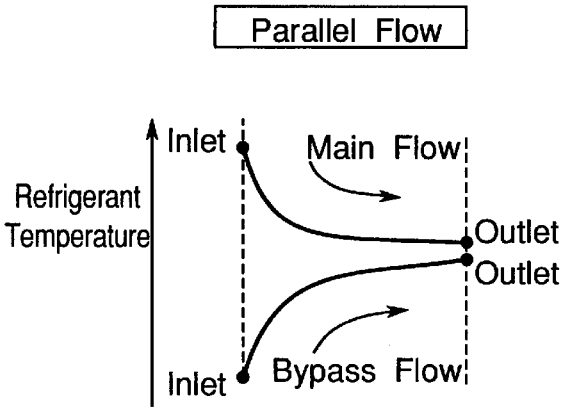
FIG. 4C is a diagram for explaining a refrigerant temperature in a parallel flow type heat exchanger.

The main circuit 6 has a compressor 2, a condenser 3, a double-pipe type heat exchanger 10 which serves as a supercooling heat exchanger, a main expansion mechanism 4 which serves as a first expansion mechanism, an evaporator 5, a four-way changeover valve 9 and an accumulator 8 in this order. The bypass circuit 13 diverges from the main circuit 6 at a junction 21 between the condenser 3 and the double-pipe type heat exchanger 10, passes through the bypass expansion mechanism 12 which serves as a second expansion mechanism and the double-pipe type heat exchanger 10 and joins the main circuit 6 at a juncture 22 in the vicinity of the accumulator 8. The double-pipe type heat exchanger 10 executes heat exchange between a main-flow refrigerant which flows through the main circuit 6 and a bypass-flow refrigerant that has passed through the bypass expansion mechanism 12 and flows through the bypass circuit 13. That is, the main-flow refrigerant is supercooled with a simple circuit construction utilizing the bypass-flow refrigerant that has passed through the bypass expansion mechanism 12. In detail, as schematically shown in FIG. 4A, the double-pipe type heat exchanger 10 has an inner pipe 10*a* and an outer pipe 10*b* provided concentrically around this inner pipe 10*a*. The directions in which the refrigerants flow are set so that the bypass-flow refrigerant flowing through the inner pipe 10*a* and the main-flow refrigerant flowing through a ring-shaped space 10*c* between the inner pipe 10*a* and the outer pipe 10*b* flow in opposite directions with interposition of the pipe wall of the inner pipe 10*a* having a heat transfer property (counter flow type heat exchanger). When such a counter flow type heat exchanger 10 is used, as shown in FIG. 4B, an average temperature difference relevant to the flow direction between the main-flow refrigerant and the bypass-flow refrigerant becomes relatively great on both sides of the pipe wall of the inner pipe 10*a* having a heat transfer property. For instance, the temperature difference becomes greater than the average temperature difference in the case of the parallel flow type heat exchanger shown in FIG. 4C. As a result, the capacity of the heat exchanger 10 can be improved.

The refrigerant discharged from the compressor 2 shown in FIG. 1A is condensed by the condenser 3 (which discharges heat to, for example, outdoor air) and diverges at the junction 21 into the main-flow refrigerant flowing through the main circuit 6 and the bypass-flow refrigerant flowing through the bypass circuit 13. This main-flow refrigerant is supercooled by heat exchange with the bypass-flow refrigerant that has passed through the bypass expansion mechanism 12 in the heat exchanger 10 and thereafter reduced in pressure by the main expansion mechanism 4. Then, the main-flow refrigerant is evaporated by the evaporator 5 (which absorbs heat from, for example, indoor air) and sucked into the compressor 2 through the four-way changeover valve 9 and the accumulator 8 for executing a gas-liquid separating operation. On the other hand, the bypass-flow refrigerant is reduced in pressure through the bypass expansion mechanism 12 and thereafter evaporated by heat exchange with the main-flow refrigerant in the heat exchanger 10. Subsequently, the bypass-flow refrigerant joins the main-flow refrigerant at the juncture 22 in the vicinity of the accumulator 8.

Figure 11B:
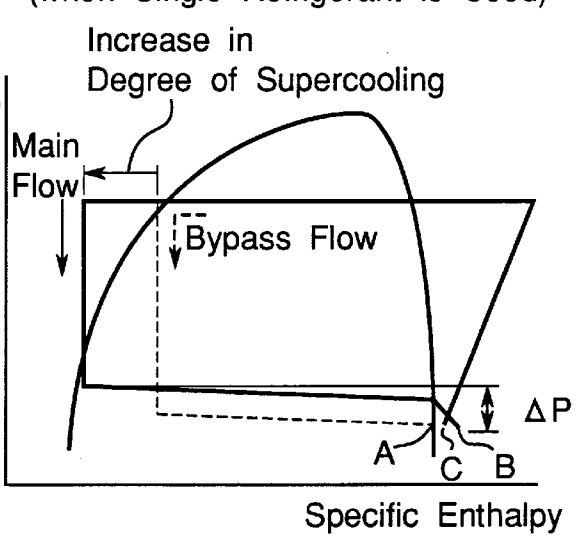
Fig.11B PRIOR ART
FIG. 11B is a Ph diagram showing the refrigeration cycle of the refrigerant circuit of FIG. 10.
Figure 11A:
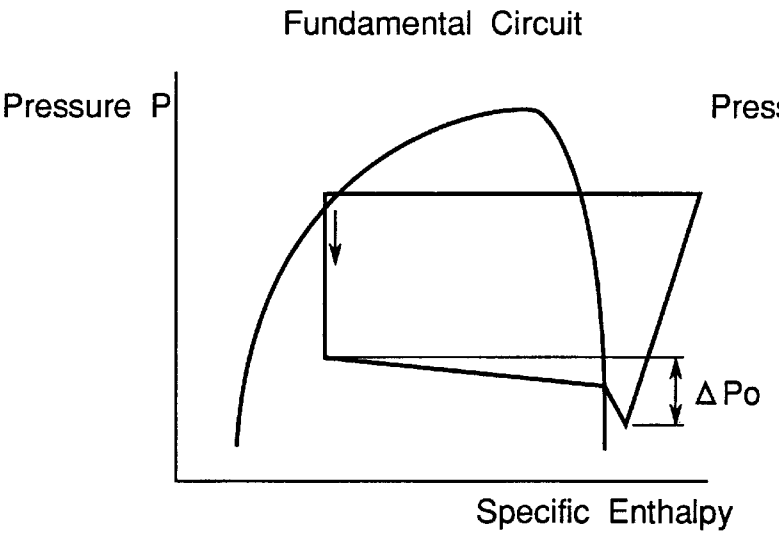
Fig.11A PRIOR ART
FIG. 11A is a Ph diagram showing the normal refrigeration cycle in which no supercooling is executed.
Figure 11C:
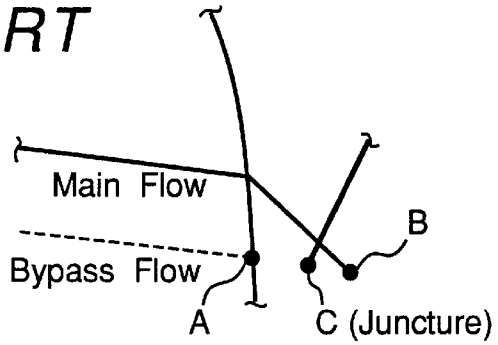
Fig.11C PRIOR ART
FIG. 11C is an enlarged view of part of the refrigeration cycle of FIG. 11B.

By thus supercooling the main-flow refrigerant in the heat exchanger 10, the refrigerating effect by the main-flow refrigerant can be increased as compared with the case where no supercooling is executed. Furthermore, by diverging the bypass flow from the refrigerant flow, the volumetric flow rate of the main-flow refrigerant is reduced. Therefore, as indicated by a pressure to specific enthalpy diagram (Ph diagram) shown in FIG. 2, a pressure loss $\Delta P$ can be reduced inside the evaporator 5 and at the inlet side pipe of the compressor 2 as compared with the case where no supercooling is executed (see FIG. 11A). Accordingly, the refrigerating capacity of the system can be improved. It is to be noted that the portions denoted by A, B and C in FIG. 2 correspond to the states at the points A, B and C in the vicinity of the juncture 22 of the refrigerant circuit 1 shown in FIG. 1A.

Figure 2:
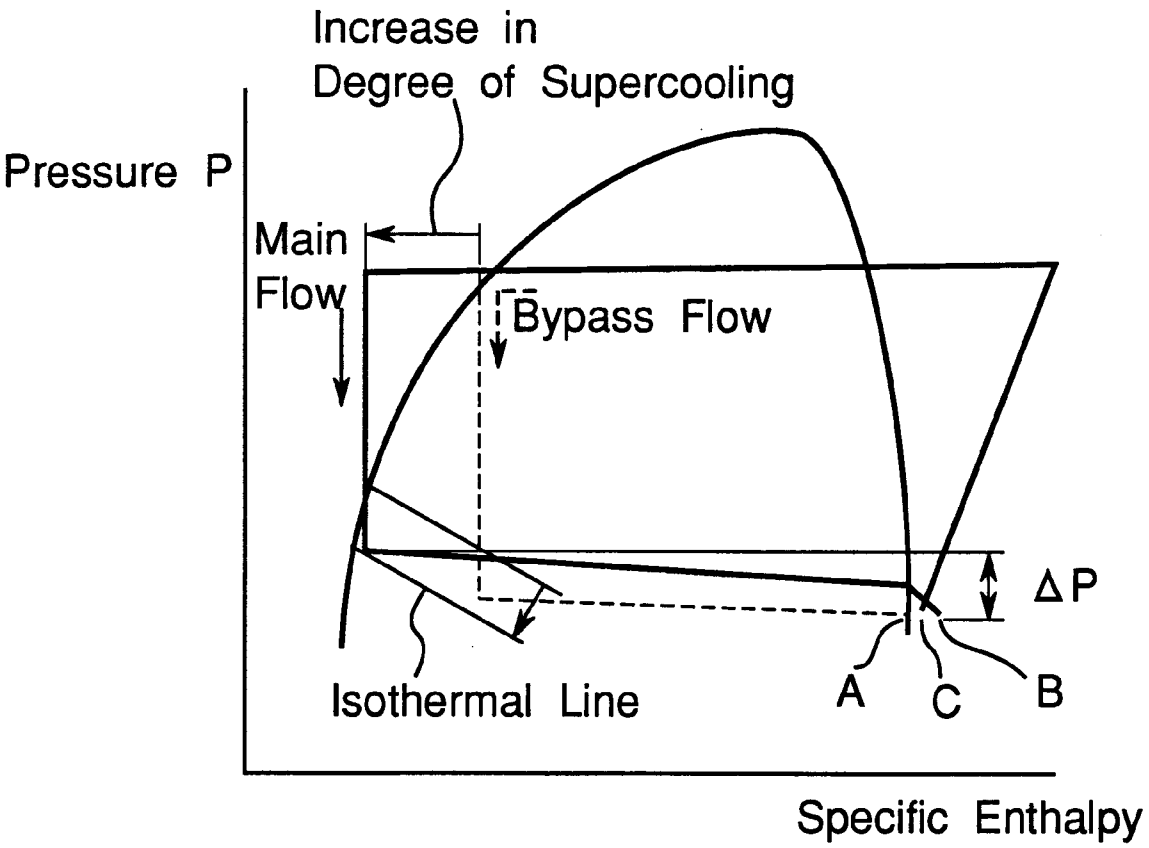
FIG. 2 is a Ph diagram showing a refrigeration cycle of the refrigerant circuit of FIG. 1A.
Figure 3:
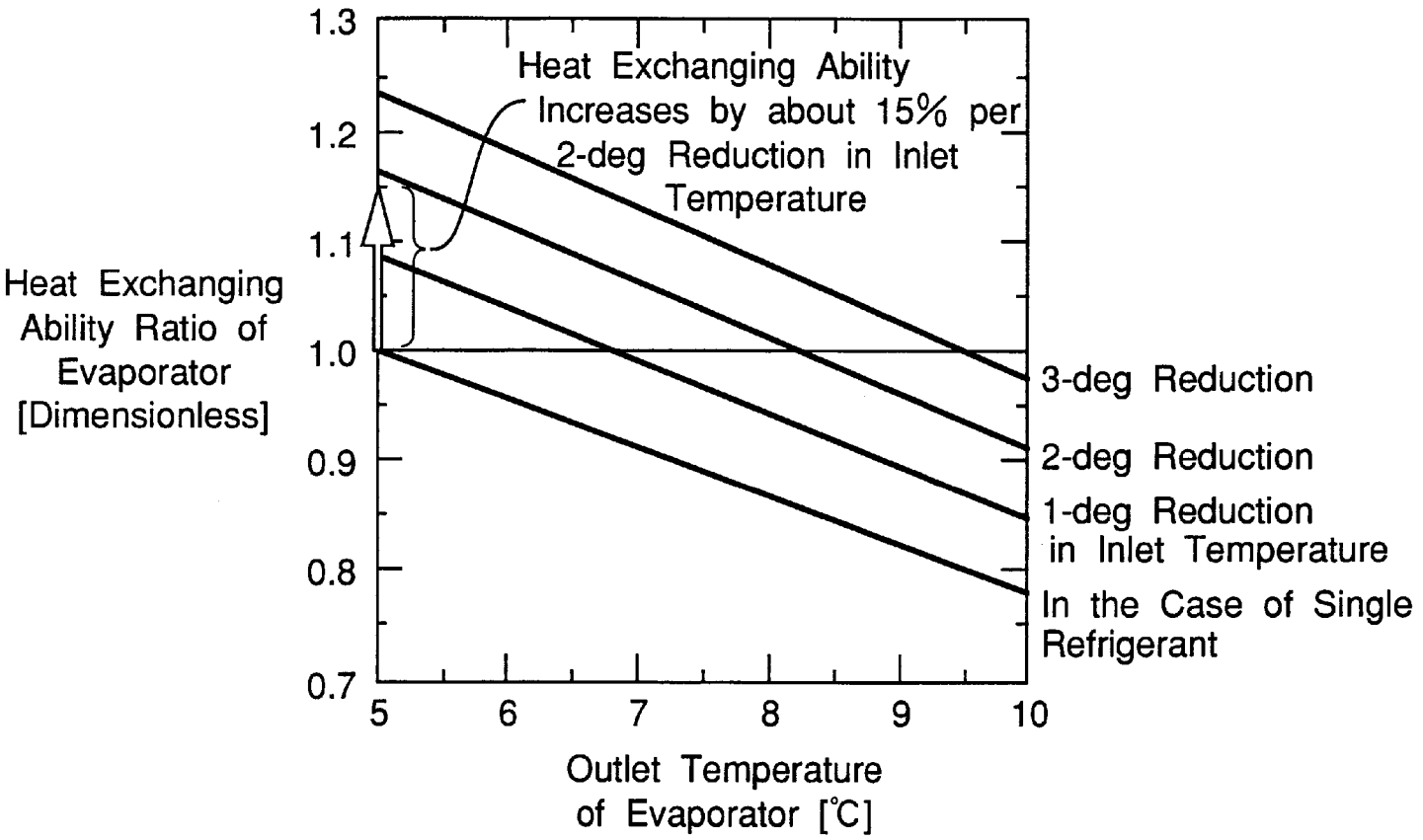
FIG. 3 is a graph for explaining the heat exchanging ability of an evaporator in the refrigerant circuit of FIG. 1A.

Furthermore, the boiling points of the refrigerants constituting the nonazeotrope refrigerant flowing through the refrigerant circuit 1 differ from each other, and therefore, a gradient (inclination to the specific enthalpy axis, referred to as a "temperature gradient" hereinafter) is generated at isothermal lines in the dual-phase region (wet steam range) of the Ph diagram shown in FIG. 2. Due to the temperature gradient in this dual-phase region, the inlet temperature of the evaporator 5 is reduced as compared with the case where a single refrigerant is used. Therefore, a temperature difference between the fluid (for example, the indoor air passing in contact with the fins of the evaporator) whose heat is absorbed by the evaporator 5 and the refrigerant passing through the evaporator 5 becomes great, thereby increasing the heat exchanging ability of the evaporator 5. For example, as shown in FIG. 3, if the inlet temperature of the evaporator 5 is reduced by 2 degrees, then the heat exchanging ability of the evaporator 5 increases by about 15%. As a result, the refrigerating capacity improving effect due to supercooling can be further increased by the quantity of the increase of the heat exchanging ability of the evaporator 5 as compared with the case where a single refrigerant is used. Furthermore, as shown in FIG. 1A, the bypass circuit 13 diverges from the main circuit 6 between the condenser 3 and the heat exchanger 10, and therefore, the object to be supercooled by the heat exchanger 10 becomes only the main-flow refrigerant. Therefore, the size of the heat exchanger 10 is allowed to be relatively small.

Figure 1B:
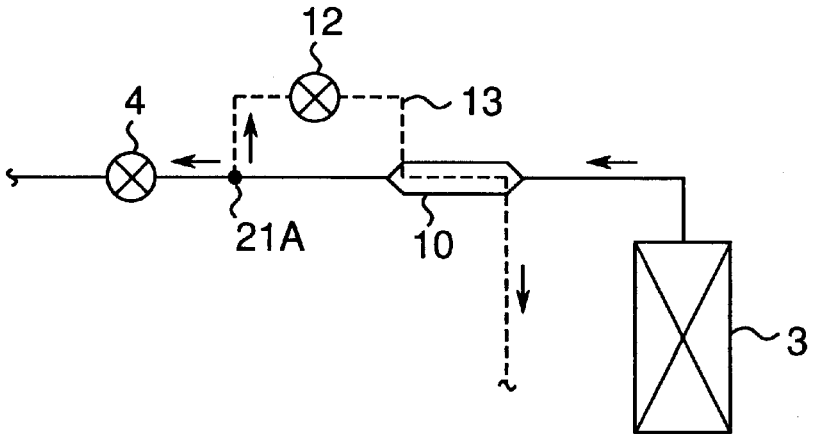
FIG. 1B is a diagram showing a modification example of the above refrigerant circuit.

It is to be noted that, as shown in FIG. 1B, the bypass circuit 13 may diverge from the main circuit 6 between the heat exchanger 10 and the main expansion mechanism 4 (at a junction 21A). In this case, the bypass-flow refrigerant diverging from the main-flow refrigerant after passing through the heat exchanger 10 enters the bypass expansion mechanism 12, and this reduces the possibility of the entry of the dual-phase flow into the bypass expansion mechanism 12. Therefore, the bypass expansion mechanism 12 has no chance to cause hunting and hence operates stably.

Figure 5:
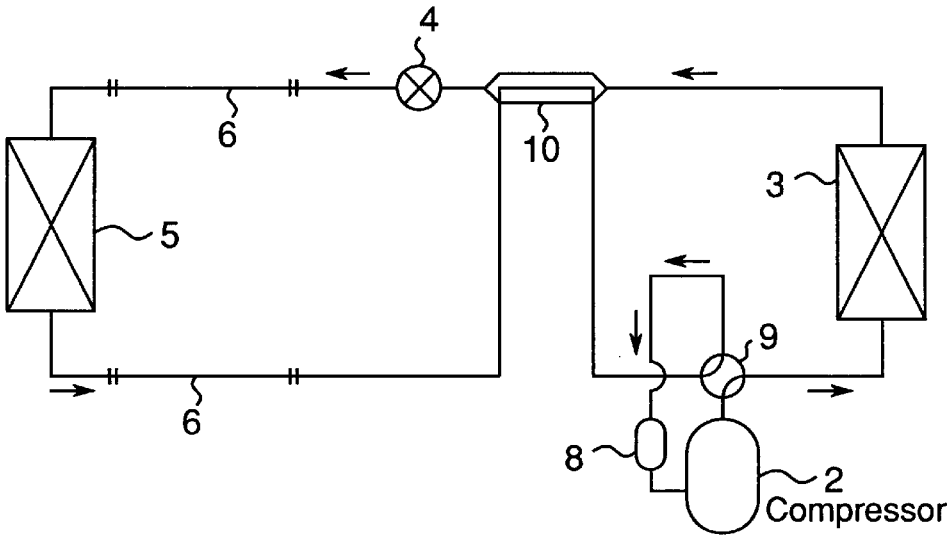
FIG. 5 is a diagram showing the construction of a refrigerant circuit in which the double-pipe type heat exchanger is used as a gas-liquid heat exchanger for comparison with the refrigerant circuit of FIG. 1A.
Figure 6:
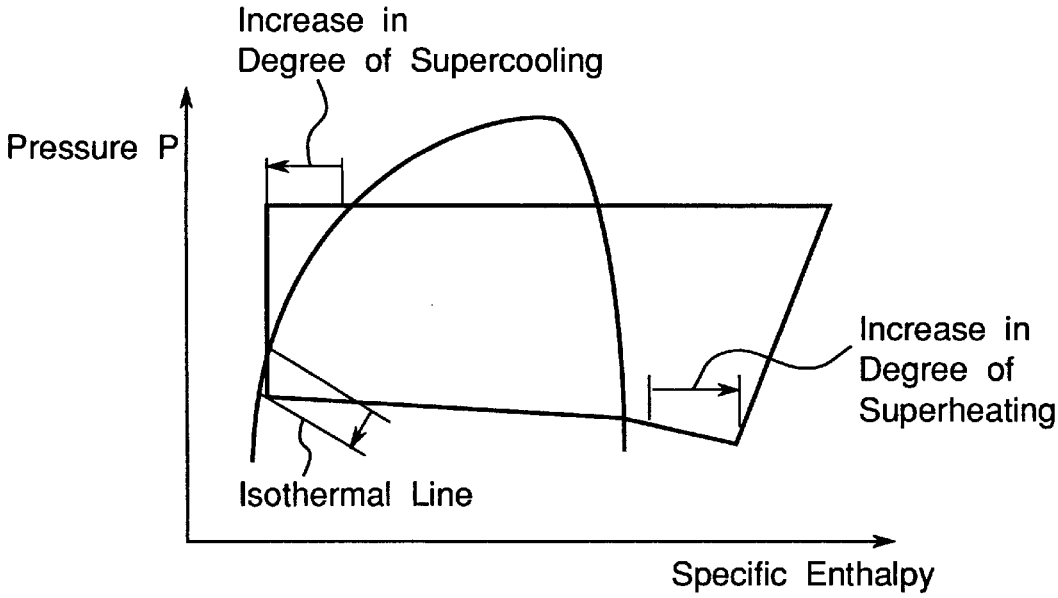
FIG. 6 is a Ph diagram showing a refrigeration cycle of the refrigerant circuit of FIG. 5.
Figure 7B:
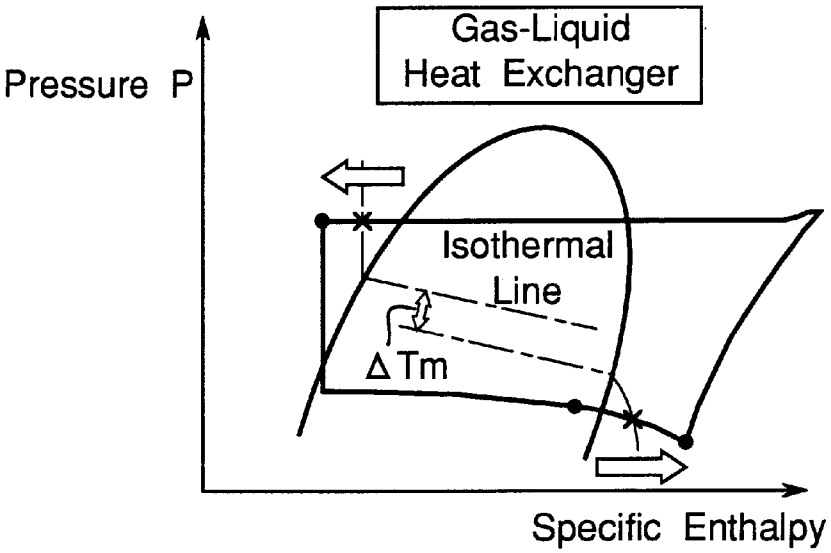
FIGS. 7A and 7B are graphs showing a comparison between the refrigeration cycle of the refrigerant circuit of FIG. 1A and the refrigeration cycle of the refrigerant circuit of FIG. 5.
Figure 7A:
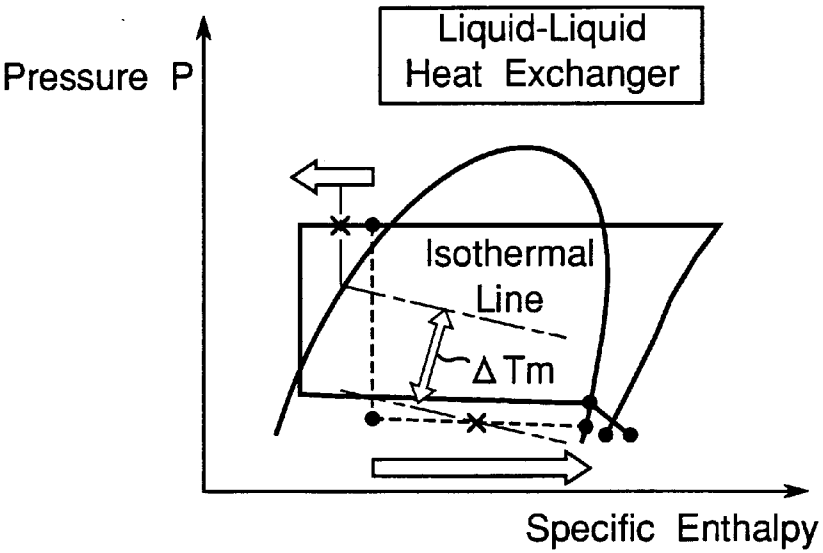

As described above, the heat exchanger 10 executes heat exchange between the main-flow refrigerant flowing through the main circuit 6 in a state in which it is condensed by the condenser 3 and the bypass-flow refrigerant that has passed through the bypass expansion mechanism 12. That is, the heat exchanger 10 basically operates as a liquid-liquid heat exchanger for executing heat exchange between the main-flow refrigerant that has passed through the condenser 3 and is prior to its passing through the evaporator 5 and the bypass-flow refrigerant. In contrast to this, as shown in FIG. 5, it is acceptable to operate the heat exchanger 10 as a gas-liquid heat exchanger by means of a main-flow refrigerant of a gaseous phase that has passed through the evaporator 5 (on the inlet side of the compressor) so as to supercool the main-flow refrigerant that has passed through the evaporator 5. However, if a heat exchanger 10 as shown in FIG. 1A is operated as a liquid-liquid heat exchanger, then an average temperature difference $\Delta Tm$ relevant to the flow direction in the heat exchanger 10 as indicated by the Ph diagram in FIG. 7A becomes greater due to the temperature gradient in the dual-phase region than $\Delta Tm$ (shown in FIG. 7B) in the case where the heat exchanger is operated as a gas-liquid heat exchanger. Therefore, the size of the heat exchanger 10 is allowed to be relatively small, causing no such trouble that the degree of superheating on the inlet side of the compressor 2 increases (see FIG. 6). As a result, the refrigerating capacity improving effect by virtue of the use of the nonazeotrope refrigerant can be more effectively produced.

Second Embodiment

Figure 8:
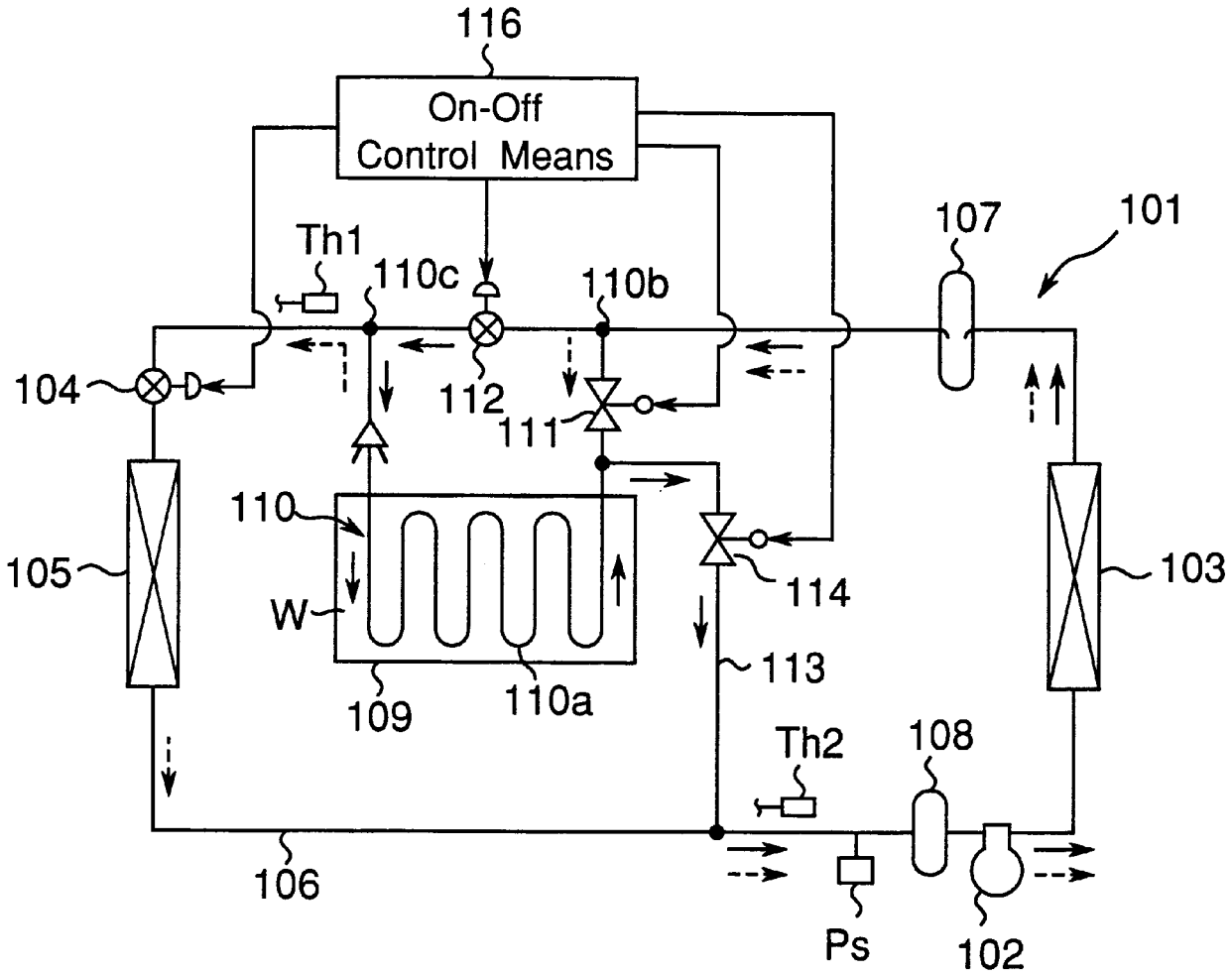
FIG. 8 is a diagram showing the construction of a refrigerant circuit of an air conditioner according to a second embodiment of the present invention.

FIG. 8 shows an air conditioner of another embodiment having a refrigerant circuit 101 for supercooling a refrigerant by means of low-temperature heat stored in ice. This refrigerant circuit 101 includes a main circuit 106 and a short-circuiting circuit 113. As a refrigerant to be circulated through the refrigerant circuit 101, a nonazeotrope refrigerant comprised of R32/134a or R-407C is used.

The main circuit 106 has a compressor 102, an outdoor heat exchanger 103 which serves as a condenser, a receiver 107 for temporarily storing the refrigerant, a second electronic expansion valve 112, a first electronic expansion valve 104 which serves as a first expansion mechanism, an indoor heat exchanger 105 which serves as an evaporator and an accumulator 108 arranged in this order. A heat storing heat exchanger 110 which serves as a supercooling heat exchanger is connected in parallel with the second electronic expansion valve 112 via an outdoor side connection end 110*b* and an indoor side connection end 110*c* of the heat storing heat exchanger 110. The heat storing heat exchanger 110 is provided with a cooling pipe 10*a* which meanders in a perpendicular direction inside a heat storage container 109 filled with water W which serves as a heat storing medium. In piping between the main body 109 of the heat storing heat exchanger 110 and the outdoor side connection end 110*b* is inserted a first on-off valve 111. The short-circuiting circuit 113 diverges from between the main body 109 of the heat storing heat exchanger 110 and the first on-off valve 111 and joins the main circuit 106 in the vicinity of the accumulator 8. A second on-off valve 114 is inserted in this short-circuiting circuit 113. Opening/closing operations of the first on-off valve 111 and the second on-off valve 114 and the degrees of opening of the first electronic expansion valve 104 and the second electronic expansion valve 112 are controlled by an on-off control means 116 according to the operating state of this air conditioner and signals from thermistors Th1 and Th2 and a pressure sensor Ps.

In a heat storing operation, the on-off control means 116 brings the first on-off valve 111 into a closed state, brings the second on-off valve 114 into an opened state and brings the first electronic expansion valve 104 into a fully closed state, while the degree of opening of the second electronic expansion valve 112 is controlled according to the signals from the thermistor Th1 and the pressure sensor Ps. In this stage, the refrigerant (whose flow direction is indicated by the solid lines in FIG. 8) discharged from the compressor 102 is condensed by the outdoor heat exchanger 103 and made to pass through the receiver 107 and the second electronic expansion valve 112. After being evaporated by heat exchange with the water W in the heat storing heat exchanger 110, the refrigerant is made to pass through the second on-off valve 114 of the short-circuiting circuit 113 and sucked into the compressor 102 through the accumulator 108 of the main circuit 106. The water W inside the heat storage container 109 is cooled by heat exchange with the refrigerant which passes through a cooling pipe 110*a* and adheres in the form of ice to the surface of the cooling pipe 110*a*. By these operations, low-temperature heat is stored in the heat storage container 109.

In a cooling operation for collecting the stored low-temperature heat, the on-off control means 116 brings the first on-off valve 111 into the opened state and brings the second on-off valve 114 into the closed state, and the degrees of opening of the first electronic expansion valve 104 and the second electronic expansion valve 112 are controlled according to the signals from the thermistor Th2 and the pressure sensor Ps. In this stage, the refrigerant (whose flow direction is indicated by dash lines in FIG. 8) discharged from the compressor 102 is condensed by the outdoor heat exchanger 103 and made to pass through the receiver 107. Subsequently, part of the refrigerant passes through the second electronic expansion valve 112 and reaches the juncture 110*c*, while the remaining refrigerant is made to pass from the junction 110*b* through the first on-off valve 111, supercooled by heat exchange with the ice generated during the heat storing operation in the heat storing heat exchanger 110 and thereafter made to reach the juncture 110*c*. In this stage, a flow ratio of the refrigerant which passes through the second electronic expansion valve 112 to the refrigerant which passes through the heat storing heat exchanger 110 is determined depending on the degree of opening of the second electronic expansion valve 112. The heat storing heat exchanger 110 supercools the refrigerant using the low-temperature heat stored in the ice, and therefore, the refrigerant which passes through the cooling pipe 110*a* can be effectively supercooled. The refrigerant which joins at the juncture 110*c* is reduced in pressure by the first electronic expansion valve 104, thereafter evaporated by heat exchange with the indoor air in the indoor heat exchanger 105 and sucked into the compressor 2 through the accumulator 8.

By thus supercooling the refrigerant in the heat storing heat exchanger 110, the refrigerating effect can be increased as compared with the case where no supercooling is executed. Furthermore, the boiling points of the refrigerants constituting the nonazeotrope refrigerant flowing into the indoor heat exchanger 105 differ from each other, and therefore, a gradient (inclination to the specific enthalpy axis, referred to as a "temperature gradient" hereinafter) is generated at the isothermal line in the dual-phase region (wet steam range) of the Ph diagram shown in FIG. 2. Due to the temperature gradient in this dual-phase region, the inlet temperature of the indoor heat exchanger 105 is reduced as compared with the case where a single refrigerant is used. Therefore, a temperature difference between the indoor air whose heat is absorbed by the indoor heat exchanger 105 and the refrigerant passing through the indoor heat exchanger 105 becomes great, thereby increasing the heat exchanging ability of the indoor heat exchanger 105. As a result, the refrigerating capacity improving effect due to supercooling can be further increased by the quantity of increase of the heat exchanging ability of the indoor heat exchanger 105 as compared with the case where a single refrigerant is used.

To execute the normal cooling operation without collecting the stored heat, it is proper to bring the first on-off valve 111 and the second on-off valve 114 into the closed state, bring the second electronic expansion valve 112 into the full-open state by the on-off control means 116 and control the degree of opening of the first electronic expansion valve 104 according to the signals from the thermistor Th2 and the pressure sensor Ps. In this stage, the refrigerant discharged from the compressor 102 is condensed by the outdoor heat exchanger 103, made to pass through the receiver 107 and the second electronic expansion valve 112, evaporated by the indoor heat exchanger 105 and sucked into the compressor 102 through the accumulator 108.

Third Embodiment

Figure 9:
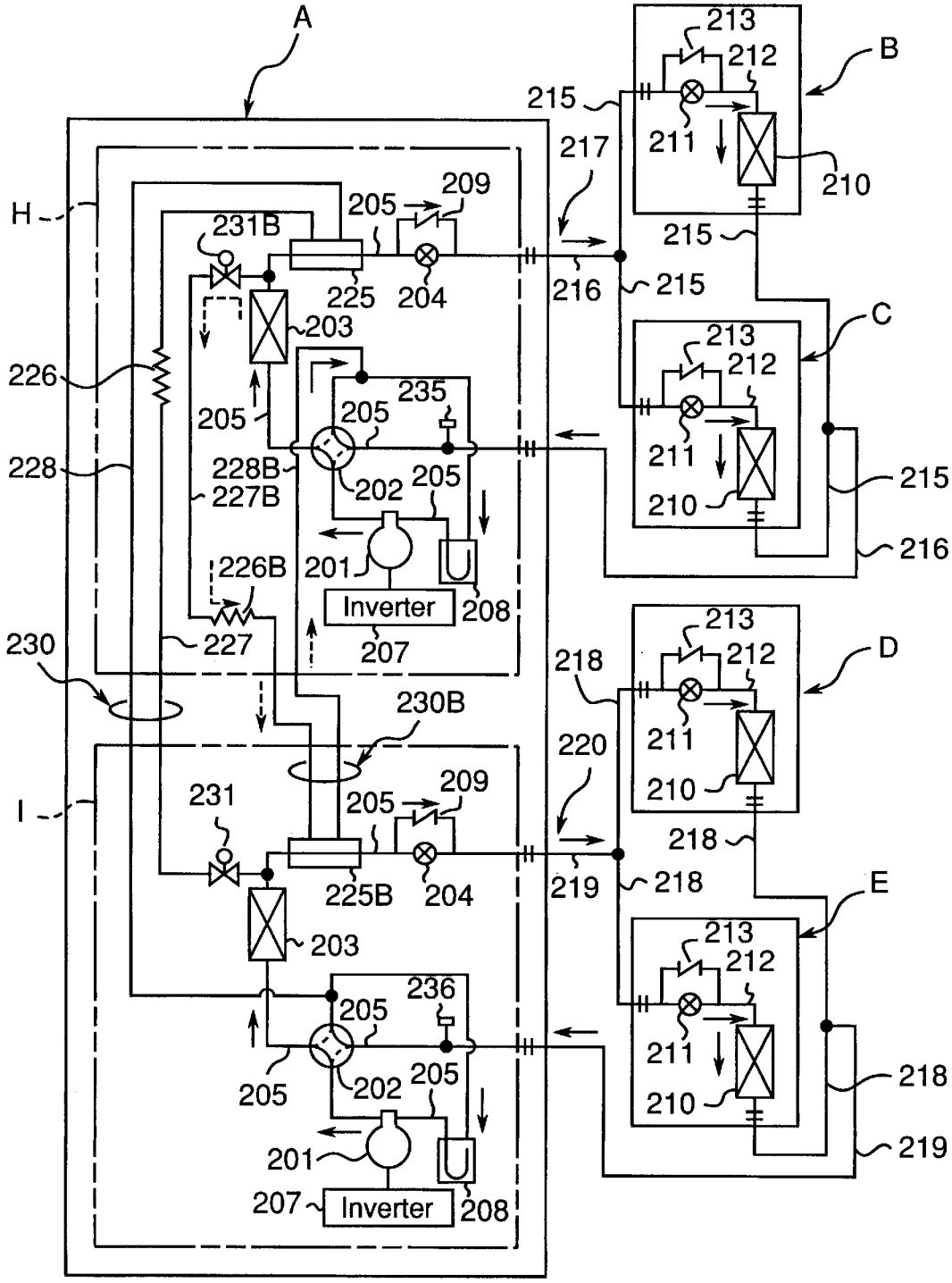
FIG. 9 is a diagram showing the construction of a refrigerant circuit of an air conditioner according to a third embodiment of the present invention.
Figure 10:
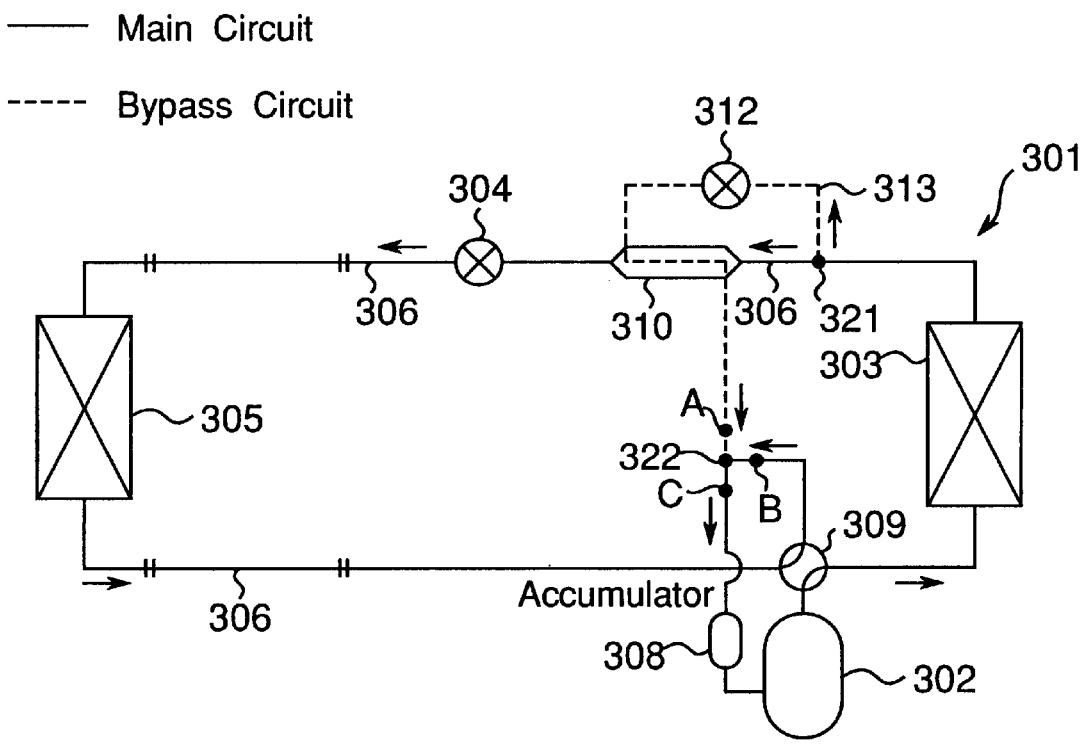
Fig.10 PRIOR ART
FIG. 10 is a diagram showing the construction of a refrigerant circuit of a prior art air conditioner.

FIG. 9 shows an air conditioner of another embodiment having a refrigerant circuit for supercooling a refrigerant by means of low-temperature heat supplied from another refrigerant circuit.

This air conditioner has one outdoor unit A including two devices H and I having identical constructions, two indoor units B and C connected to one device H of the outdoor unit A and two indoor units D and E connected to the other device I of the outdoor unit A.

The one device H of the outdoor unit A has a construction in which an accumulator 208, a compressor 201 driven by an inverter 207, a four-way changeover valve 202, an outdoor heat exchanger 203, a supercooling heat exchanger 225, a check valve 209 which allows the refrigerant to pass in only one direction (the direction indicated by the solid lines in the figure) in a cooling operation and an expansion mechanism 204 for a heating operation connected in parallel with this check valve 209 are connected together by way of a refrigerant pipe 205. Similarly, the other device I has a construction in which an accumulator 208, a compressor 201 driven by an inverter 207, a four-way changeover valve 202, an outdoor heat exchanger 203, a supercooling heat exchanger 225B, a check valve 209 which allows the refrigerant to pass in only one direction in a cooling operation and an expansion mechanism 204 for a heating operation connected in parallel with this check valve 209 are connected together by way of a refrigerant pipe 205. The indoor units B, C, D and E have identical internal constructions in which an indoor heat exchanger 210, a check valve 213 which allows the refrigerant to pass in the heating operation only in the direction opposite to the direction of the cooling operation and an expansion mechanism 211 for the cooling operation connected in parallel with this check valve 213 are connected together by way of a refrigerant pipe 212. The following will describe the cooling operation.

The indoor units B and C are connected in parallel with each other by way of refrigerant pipes 215 and 215 and are connected to the one device H of the outdoor unit A by way of other refrigerant pipes 216 and 216 while allowing the refrigerant to circulate, thereby forming one refrigerant circuit 217. Similarly, the indoor units D and E are connected in parallel with each other by way of refrigerant pipes 218 and 218 and are connected to the other device I of the outdoor unit A by way of other refrigerant pipes 219 and 219 while allowing the refrigerant to circulate, thereby forming another refrigerant circuit 220. On the inlet side (in the vicinity of the refrigerant inlet of the outdoor unit A) of the compressor 201 of the refrigerant circuits 217 and 220 are provided pressure sensors 235 and 236, respectively, for detecting the operating states of the respective refrigerant circuits.

As the refrigerant to be circulated through these refrigerant circuits 217 and 220, a nonazeotrope refrigerant comprised of R-32/134a or R-407C is used.

Between the refrigerant circuit 217 on the device H side and the refrigerant circuit 220 on the device I side are provided bypass circuits 230 and 230B. The bypass circuit 230 (having refrigerant pipes 227 and 228) diverges from the downstream side (in the vicinity of the outlet in the cooling operation) of the outdoor heat exchanger 203 of the refrigerant circuit 220, passes through an on-off valve 231, an expansion mechanism 226 and a supercooling heat exchanger 225 of the refrigerant circuit 217 and joins its refrigerant circuit 220 in the vicinity of the inlet of the accumulator 208 of the refrigerant circuit 220. The bypass circuit 230B (having refrigerant pipes 227B and 228B) diverges from the downstream side (in the vicinity of the outlet in the cooling operation) of the outdoor heat exchanger 203 of the refrigerant circuit 217, passes through an on-off valve 231B, an expansion mechanism 226B and a supercooling heat exchanger 225B of the refrigerant circuit 220 and joins its refrigerant circuit 217 in the vicinity of the inlet of the accumulator 208 of the refrigerant circuit 217. The supercooling heat exchanger 225 is constructed similar to, for example, the double-pipe type heat exchanger 10 shown in FIG. 4A and executes heat exchange between the main-flow refrigerant flowing through the refrigerant circuit 217 and the bypass-flow refrigerant flowing through the bypass circuit 230 which diverges from the refrigerant circuit 220. On the other hand, the supercooling heat exchanger 225B executes heat exchange between the main-flow refrigerant flowing through the refrigerant circuit 220 and the bypass-flow refrigerant flowing through the bypass circuit 230B which diverges from the refrigerant circuit 217.

In the normal cooling operation in which no supercooling is executed, the on-off valves 231 and 231B of the bypass circuits 230 and 230B are brought into the closed state by a control means (not shown). In this stage, the refrigerant circuit 217 and the refrigerant circuit 220 execute cooling operations independently of each other. In, for example, the refrigerant circuit 220, the refrigerant (whose flow direction is indicated by the solid lines in FIG. 9) discharged from the compressor 201 is condensed by the outdoor heat exchanger 203 which operates as a condenser and made to pass through the heat exchanger 225B in the state in which it executes no heat exchange and the check valve 209. Subsequently, the refrigerant is reduced in pressure by the expansion mechanism 211 of the indoor units D and E, evaporated by the indoor heat exchanger 210 which operates as an evaporator and sucked into the compressor 201 through the accumulator 208 of the outdoor unit A. The same operation is executed in the refrigerant circuit 217.

Assume now that a decision is made so that there is a surplus of low-temperature heat on, for example, the refrigerant circuit 217 side and there is a shortage of low-temperature heat on the refrigerant circuit 220 side based on the outputs of the pressure sensors 235 and 236 while the refrigerant circuits 217 and 220 are executing the cooling operations. According to this result of decision, the control means brings the on-off valve 231 into the closed state and brings the on-off valve 231B into the opened state, thereby shifting the operation of the refrigerant circuit 220 into the cooling operation for executing supercooling. In this stage, part of the refrigerant flowing through the refrigerant circuit 217 diverges to flow as a bypass-flow refrigerant (whose flow direction is indicated by dash lines in FIG. 9) through the bypass circuit 230B. As a result, the supercooling heat exchanger 225B executes heat exchange between the main-flow refrigerant flowing through the refrigerant circuit 220 and the bypass-flow refrigerant flowing through the bypass circuit 230B. That is, in the refrigerant circuit 220, the refrigerant discharged from the compressor 201 is condensed by the outdoor heat exchanger 203 which operates as a condenser and supercooled by the heat exchanger 225B. Then, the refrigerant passes through the check valve 209. Subsequently, the refrigerant is reduced in pressure by the expansion mechanisms 211 of the indoor units D and E, evaporated by the indoor heat exchanger 210 which operates as an evaporator and then sucked into the compressor 201 through the accumulator 208 of the outdoor unit A.

As described above, by supercooling the refrigerant in the heat exchanger 225B, the refrigerating effect can be increased as compared with the case where no supercooling is executed. Furthermore, the boiling points of the refrigerants constituting the nonazeotrope refrigerant flowing into the indoor heat exchanger 210 differ from each other, and therefore, a gradient (inclination to the specific enthalpy axis, referred to as a "temperature gradient" hereinafter) is generated at the isothermal line in a dual-phase region (wet steam range) of the Ph diagram shown in FIG. 2. Due to the temperature gradient in this dual-phase region, the inlet temperature of the indoor heat exchanger 210 is reduced as compared with the case where a single refrigerant is used. Therefore, a temperature difference between the indoor air whose heat is absorbed by the indoor heat exchanger 210 and the refrigerant passing through the indoor heat exchanger 210 becomes great, thereby increasing the heat exchanging ability of the indoor heat exchanger 210. As a result, the refrigerating capacity improving effect due to supercooling can be further increased by the quantity of increase of the heat exchanging ability of the indoor heat exchanger 210 as compared with the case where a single refrigerant is used.

If it is decided that there is a surplus of low-temperature heat on the refrigerant circuit 220 side and there is a shortage of low-temperature heat on the refrigerant circuit 217 side conversely to the above case based on the outputs of the pressure sensors 235 and 236 while the refrigerant circuits 217 and 220 are executing the cooling operations, then according to this result of decision, the control means sets the on-off valve 231 to the opened state and sets the on-off valve 231B to the closed state, thereby shifting the operation of the refrigerant circuit 217 into the cooling operation for executing supercooling.

INDUSTRIAL APPLICABILITY

The present invention can be applied to an air conditioner having a refrigerant circuit which executes supercooling and is useful for improving the refrigerating capacity of the air conditioner.

What is claimed is:

1. An air conditioner having a refrigerant circuit in which a refrigerant flows through a compressor, a condenser, a supercooling heat exchanger, a first expansion mechanism and an evaporator in this order, wherein a nonazeotrope refrigerant is used as the refrigerant and, wherein the supercooling heat exchanger supercools the refrigerant by means of low-temperature heat stored in ice.

2. An air conditioner as claimed in claim 1, wherein the refrigerant circuit has a bypass circuit which diverges from a main circuit between the condenser and the first expansion mechanism and joins the main circuit on the inlet side of the compressor and includes a second expansion mechanism in the bypass circuit, and wherein the supercooling heat exchanger executes heat exchange between a main-flow refrigerant flowing through the main circuit and a bypass-flow refrigerant that has passed through the second expansion mechanism and flows through the bypass circuit.

3. An air conditioner as claimed in claim 2, wherein the bypass circuit diverges from the main circuit between the condenser and the supercooling heat exchanger.

4. An air conditioner as claimed in claim 3, wherein the supercooling heat exchanger is a counter flow type heat exchanger in which the main-flow refrigerant and the bypass-flow refrigerant flow in opposite directions with interposition of a wall having a heat transfer property.

5. An air conditioner as claimed in claim 2, wherein the bypass circuit diverges from the main circuit between the supercooling heat exchanger and the first expansion mechanism.

6. An air conditioner as claimed in claim 5, wherein the supercooling heat exchanger is a counter flow type heat exchanger in which the main-flow refrigerant and the bypass-flow refrigerant flow in opposite directions with interposition of a wall having a heat transfer property.

7. An air conditioner as claimed in claim 2, wherein the supercooling heat exchanger is a counter flow type heat exchanger in which the main-flow refrigerant and the bypass-flow refrigerant flow in opposite directions with interposition of a wall having a heat transfer property.

8. An air conditioner having a refrigerant circuit in which a refrigerant flows through a compressor, a condenser, a supercooling heat exchanger, a first expansion mechanism and an evaporator in this order, wherein a nonazeotrope refrigerant is used as the refrigerant and wherein the supercooling heat exchanger of the refrigerant circuit supercools the refrigerant by means of low-temperature heat supplied from another refrigerant circuit.

9. An air conditioner as claimed in claim 8, wherein the refrigerant circuit has a bypass circuit which diverges from a main circuit between the condenser and the first expansion mechanism and joins the main circuit on the inlet side of the compressor and includes a second expansion mechanism in the bypass circuit, and wherein the supercooling heat exchanger executes heat exchange between a main-flow refrigerant flowing through the main circuit and a bypass-flow refrigerant that has passed through the second expansion mechanism and flows through the bypass circuit.

10. An air conditioner as claimed in claim 9, wherein the bypass circuit diverges from the main circuit between the condenser and the supercooling heat exchanger.

11. An air conditioner as claimed in claim 10, wherein the supercooling heat exchanger is a counter flow type heat exchanger in which the main-flow refrigerant and the bypass-flow refrigerant flow in opposite directions with interposition of a wall having a heat transfer property.

12. An air conditioner as claimed in claim 9, wherein the bypass circuit diverges from the main circuit between the supercooling heat exchanger and the first expansion mechanism.

13. An air conditioner as claimed in claim 12, wherein the supercooling heat exchanger is a counter flow type heat exchanger in which the main-flow refrigerant and the bypass-flow refrigerant flow in opposite directions with interposition of a wall having a heat transfer property.

14. An air conditioner as claimed in claim 9, wherein the supercooling heat exchanger is a counter flow type heat exchanger in which the main-flow refrigerant and the bypass-flow refrigerant flow in opposite directions with interposition of a wall having a heat transfer property.

* * * * *